US007536872B2

(12) United States Patent
Ohta et al.

(10) Patent No.: US 7,536,872 B2
(45) Date of Patent: May 26, 2009

(54) HIGH PRESSURE CONTROL VALVE

(75) Inventors: Hiromi Ohta, Okazaki (JP); Nobuharu Kakehashi, Toyoake (JP)

(73) Assignee: Denso Corporation, Kariya (JP)

( * ) Notice: Subject to any disclaimer, the term of this patent is extended or adjusted under 35 U.S.C. 154(b) by 16 days.

(21) Appl. No.: 11/593,431

(22) Filed: Nov. 6, 2006

(65) Prior Publication Data

US 2007/0107461 A1 May 17, 2007

(30) Foreign Application Priority Data

Nov. 14, 2005 (JP) ..... 2005-329289

(51) Int. Cl.
*F25B 41/06* (2006.01)

(52) U.S. Cl. ..... 62/527; 62/222

(58) Field of Classification Search ..... 62/222, 62/513, 527

See application file for complete search history.

(56) References Cited

U.S. PATENT DOCUMENTS 5,524,455 A * 6/1996 Hasegawa et al. ..... 62/513
5,890,370 A 4/1999 Sakakibara et al.
6,012,300 A 1/2000 Tomatsu et al.

FOREIGN PATENT DOCUMENTS

EP 0 786 632 7/1997
EP 0 892 226 1/1999
EP 1 691 149 8/2006
JP 9-264622 10/1997
JP 2000-193347 7/2000
KR 10-2004 00078942 9/2004

OTHER PUBLICATIONS

Search Report dated Feb. 16, 2007 in European Application No. 06 02 3355.
Office Action dated Nov. 30, 2007 in Chinese Application No. 2006 10144793 with English translation thereof.
Office Action dated Nov. 28, 2007 in Korean Application No. 10-2006-0111311 with English translation thereof.
Office Action dated Aug. 15, 2008 in Chinese Application No. 2006 10 144793 with English translation thereof.

* cited by examiner

*Primary Examiner*—Melvin Jones
(74) *Attorney, Agent, or Firm*—Harness, Dickey & Pierce, PLC

(57) ABSTRACT

A high pressure control valve is arranged in a refrigerant passage formed from an internal heat exchanger to an evaporator 4 in a refrigerating cycle of $CO_2$ refrigerant having the internal heat exchanger 8. The high pressure control valve 3, 3A to 3F controls refrigerant pressure on the internal heat exchanger outlet side according to a temperature of the refrigerant at the outlet of the radiator. Into a temperature sensing section (airtightly closed space A), the inner pressure of which is changed according to the refrigerant temperature on the radiator outlet side, $CO_2$ refrigerant, the charging density of which is 200 to 600 kg/m$^3$, preferably 200 to 450 kg/m$^3$, is charged.

11 Claims, 11 Drawing Sheets

HIGH PRESSURE CONTROL VALVE

BACKGROUND OF THE INVENTION

1. Field of the Invention

The present invention relates to a high pressure control valve (expansion valve) which can be applied to a refrigerating cycle using a refrigerant, such as carbon dioxide ($CO_2$), which is in a supercritical state.

2. Description of the Related Art

In general, in a case where $CO_2$ is used as a refrigerant, the theoretical efficiency of the refrigerating cycle is lower than that of the HFC 134a refrigerant which has been conventionally used.

Therefore, as shown in FIG. 1, it is necessary to enhance the COP (coefficient of performance) of the refrigerating cycle by exchanging heat between the refrigerant leaving the gas cooler (radiator) 2 and the refrigerant entering the compressor 1 using an internal heat exchanger 8. When the internal heat exchanger 8 is used, the refrigerant entering the compressor is heated. Therefore, the enthalpy "i" is increased, and the refrigerant is superheated.

FIG. 8A is a graph showing an effect of the enhancement of COP in the case where the refrigerant entering the compressor is superheated in the internal heat exchanger 8. In this connection, TS in the drawing represents the refrigerant evaporation temperature of the evaporator 4. The higher the temperature of the refrigerant in the evaporator 4 is, the more the effect of the enhancement of COP is enhanced. In the case of an air conditioner for vehicle use, at the time of an idling operation, the rotating speed of the compressor 1 is lowered. Therefore, concerning the air-conditioner for vehicle use, its cooling capacity is low. As the refrigerant evaporation temperature in the evaporator 4 is raised, an effect of enhancement of COP of the internal heat exchanger 8 is increased. Accordingly, a great advantage can be provided by using the internal heat exchanger 8.

FIG. 8B is a graph showing a pressure control for controlling the pressure at which COP is maximized with respect to the temperature of the refrigerant leaving the radiator 2. As shown in the graph, the following characteristic is known. In the case where the refrigerant entering the compressor 1 is heated with the internal heat exchanger 8, the refrigerant evaporation temperature in the evaporator 4 is high. The higher the temperature of the refrigerant leaving the radiator 2, the lower the control pressure in the case where the refrigerant is superheated. In this connection, SH as shown in the drawing represents superheating.

The reason why the above characteristic is provided will be described as follows. In the Mollier chart shown in FIG. 9, in which the physical property of $CO_2$ is shown, the refrigerant, which has been sucked by the compressor 1, ideally follows an isentropic curve and is compressed to a refrigerant at high temperature and high pressure. According to the physical property of the refrigerant of $CO_2$, an inclination of the isentropic curve "s" is reduced on the right side of the Mollier chart where enthalpy is increased. When a comparison is made at the same pressure, as compared with a case in which a saturated gas refrigerant is sucked and compressed, an increase in the enthalpy "i" (=power of the compressor) in the case of compressing the refrigerant to the same pressure becomes larger than when the superheated refrigerant is compressed.

Therefore, in the refrigerating cycle in which $CO_2$ refrigerant is used, a control method is known in which the pressure of the refrigerant is controlled to a high pressure at which COP is maximized with respect to the refrigerant temperature at the outlet of the radiator 2. However, in the case where the internal heat exchanger 8 is provided, as the power for driving the compressor 1 is increased, the pressure at which COP is maximized becomes low. When the control pressure is reduced as described above, an advantage can be provided in that the durability of the other high pressure parts, such as a compressor 1 and a radiator 2, can be enhanced.

At the time of idling operation of a vehicle, no air flow is generated. Accordingly, the air flow to the radiator 2 is decreased. In addition to that, due to a flow of hot air flowing from an engine compartment, a suction air temperature is raised and a temperature of the refrigerant leaving the radiator 2 is increased. Therefore, in the case where the internal heat exchanger 8 is used, it is necessary to use a high pressure control valve 3 having a control characteristic in which the control pressure is low with respect to the same temperature of the refrigerant leaving the radiator.

Concerning the high pressure control valve (expansion valve) for controlling the pressure of $CO_2$ in the supercritical state, the official gazettes of JP-A-9-264622 (patent document 1) and JP-A-2000-193347 (patent document 2) disclose high pressure control valves which are well known.

In the above patent documents 1 and 2, as a temperature sensing section for operating a displacement member of the control valve, a high pressure control valve is shown in which the same $CO_2$ refrigerant, as the refrigerant circulating in a refrigerating cycle, is charged into an air-tightly closed space. Especially, in the patent document 1, a high pressure control valve is shown in which a charging density of charging $CO_2$ refrigerant into the air-tightly closed space is 450 kg/m$^3$ to 950 kg/m$^3$. However, the high pressure control valves shown in these patent documents 1 and 2 are applied to a refrigerating cycle in which an internal heat exchanger 8 is not used. That is, it is difficult for the high pressure control valves shown in these patent documents 1 and 2 to be applied to a refrigerating cycle including the internal heat exchanger 8.

SUMMARY OF THE INVENTION

The present invention has been accomplished in view of the above problems of the prior art. An object of the present invention is to provide a high pressure control valve characterized in that: the high pressure control valve can be applied to a refrigerating cycle having an internal heat exchanger; the COP of the cycle can be enhanced; cooling-down can be facilitated; it is unnecessary that a mechanical strength of an element, in which an airtightly closed space (temperature sensing section) charged with $CO_2$ is formed, is excessively enhanced, that is, the mechanical strength of the element can be made to be the same as that of the other high pressure parts; and the manufacturing cost is low.

A high pressure control valve of the present invention is arranged in a refrigerant passage formed from an internal heat exchanger to an evaporator in a refrigerating cycle, in which a refrigerant, the pressure of which is the supercritical pressure, is used, having an internal heat exchanger. The high pressure control valve controls the refrigerant pressure on the internal heat exchanger outlet side, based on a temperature of the refrigerant leaving a radiator. In the high pressure control valve, into a temperature sensing section, the inner pressure of which is changed according to the refrigerant temperature on the radiator outlet side, the refrigerant, the charging density of which is 200 to 600 kg/m$^3$, is charged under the condition that the valve body is closed. Due to the foregoing, it becomes unnecessary to excessively enhance the mechanical strength of the temperature sensing section, that is, the mechanical strength of the temperature sensing section can be made to be the same as that of the other high pressure parts. Therefore, the manufacturing cost can be reduced.

In a high pressure control valve of the present invention, the charging density of charging the refrigerant into the temperature sensing section is limited to 200 to 450 kg/m$^3$. Therefore, the control pressure can be further reduced. Accordingly, it becomes unnecessary to increase a mechanical strength of the temperature sensing section. In this connection, the above refrigerant density is a charging density under the condition that the valve body is closed.

In a high pressure control valve of the present invention, the high pressure control valve is opened when the high pressure is raised higher than the inner pressure of the temperature sensing section by a predetermined value. This shows that the charging density of charging the refrigerant into the temperature sensing section can be reduced when a force of pushing the valve in the valve closing direction is given by a thing except for the inner pressure of the refrigerant charged into the temperature sensing section.

In a high pressure control valve of the present invention, a load corresponding to the predetermined value is given by either an elastic member or a noncondensable gas charged into the temperature sensing section together with the refrigerant or by a combination of them. Examples of the noncondensable gas are nitrogen gas and helium gas.

In a high pressure control valve of the present invention, a force of the elastic member is an elastic force of a coil spring, an elastic force generated by a diaphragm itself or an elastic force generated by a bellows or an elastic force generated by a combination of them. Due to the foregoing, the charging density of charging the refrigerant into the temperature sensing section can be further reduced.

In a high pressure control valve of the present invention, when the temperature of the refrigerant leaving the radiator is not less than 50° C., the refrigerant sucked by the compressor is heated by the internal heat exchanger so that the superheat can be 10° C. or more. Due to the foregoing, the charging density of charging the refrigerant into the temperature sensing section can be reduced and the control pressure can also be reduced without lowering the COP of the refrigerating cycle.

The present invention may be more fully understood from the description of preferred embodiments of the invention, as set forth below, together with the accompanying drawings.

DESCRIPTION OF THE PREFERRED EMBODIMENTS

Figure 1:
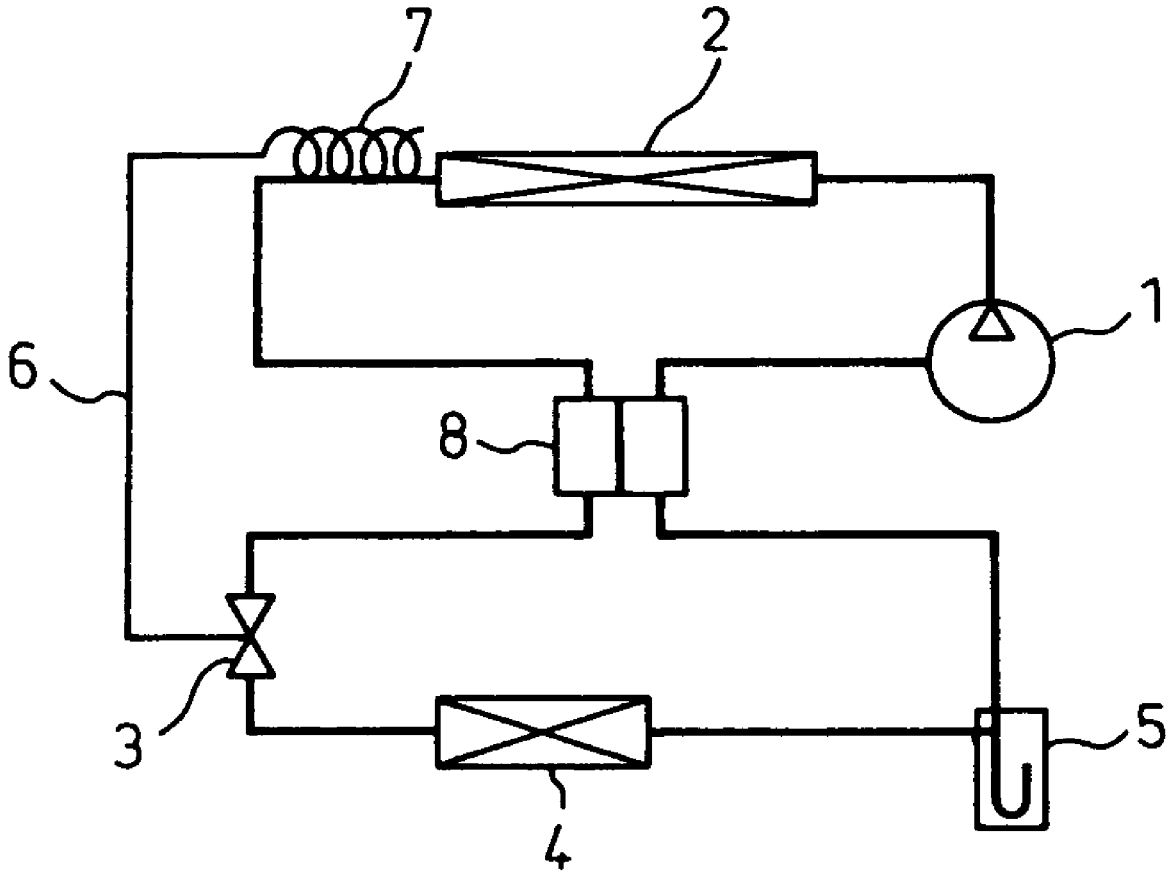
FIG. 1 is a schematic drawing for explaining a refrigerating cycle including an internal heat exchanger into which a high pressure control valve of an embodiment of the present invention is incorporated.
Figure 2:
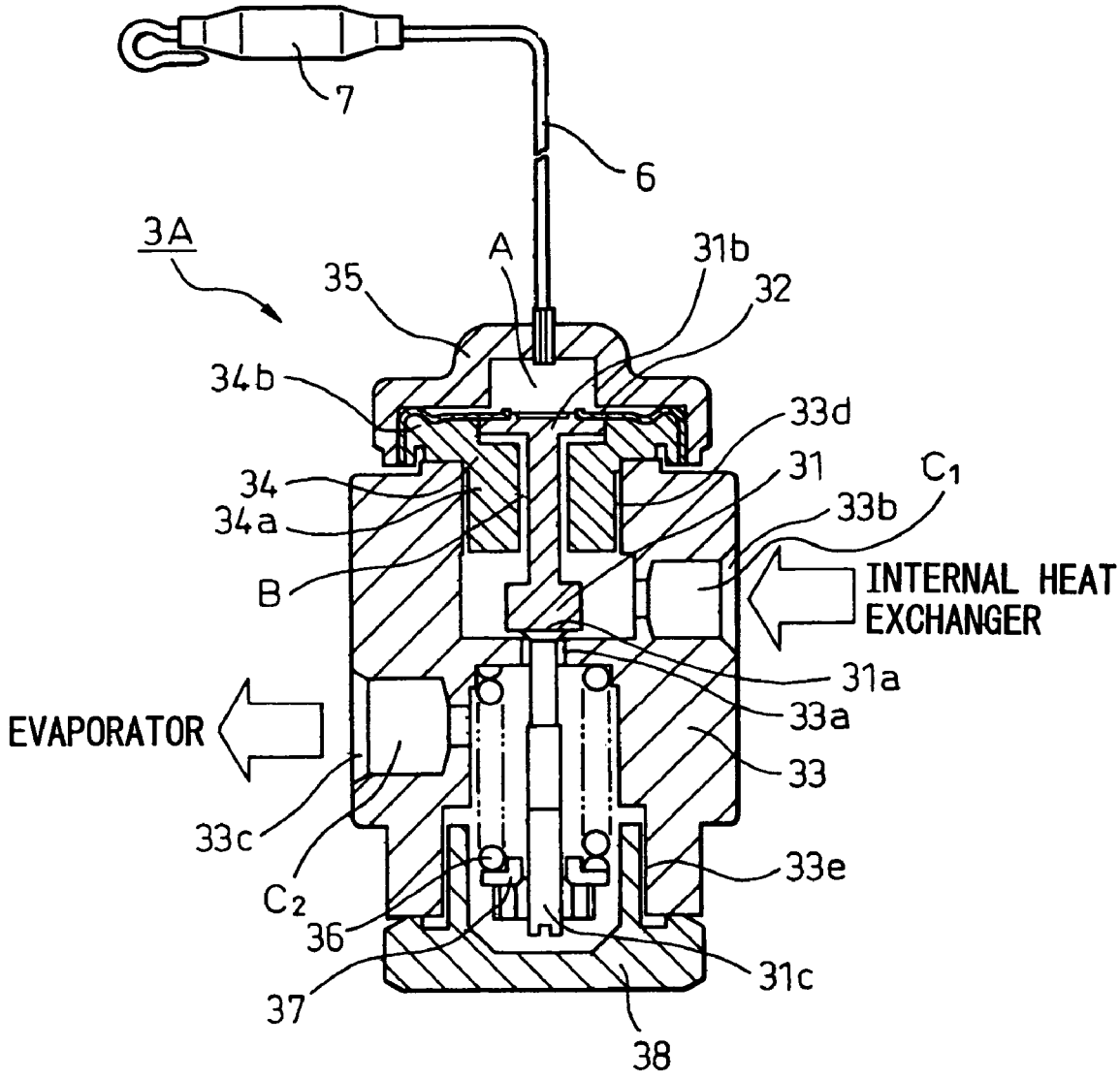
FIG. 2 is a sectional view showing a high pressure control valve of a first embodiment of the present invention.

Referring to the drawings, a high pressure control valve of the embodiment of the present invention will be explained below. FIG. 1 is a schematic illustration for explaining a refrigerating cycle (supercritical refrigerating cycle) into which an internal heat exchanger is incorporated and in which the carbon dioxide. ($CO_2$) refrigerant is circulated. The high pressure control valve of the embodiment of the present invention is preferably used for a refrigerating cycle into which the internal heat exchanger is incorporated. FIG. 2 is a sectional view showing a high pressure control valve of the first embodiment applied to the refrigerating cycle shown in FIG. 1. In FIG. 1, reference numeral 1 is a compressor for sucking and compressing refrigerant ($CO_2$) and reference numeral 2 is a gas cooler (radiator) for cooling the refrigerant compressed by the compressor 1. The refrigerant cooled by the radiator 2 is further cooled by the internal heat exchanger 8 and sent to a high pressure control valve (expansion valve) 3. The high pressure control valve 3 controls pressure of the refrigerant on the outlet side of the internal heat exchanger 8 according to the refrigerant temperature on the outlet side of the radiator 2. At the same time, the high pressure control valve 3 functions as a pressure reducing device for reducing the high pressure of the refrigerant. A temperature sensing cylinder 7 is provided on a pipe on the outlet side of the radiator 2. This temperature sensing cylinder 7 is connected to the expansion valve 3 through a capillary tube 6. Therefore, according to a change in the inner pressure of the gas charged into the temperature sensing cylinder 7, a degree of the valve opening of the expansion valve 3 is controlled. In the present invention, the gas charged into the temperature sensing cylinder 7 is $CO_2$ which is the same as the circulating refrigerant.

Reference numeral 4 is an evaporator for evaporating 2-phase refrigerant (gas and liquid), the pressure of which has been reduced by the high pressure control valve 3. Reference numeral 5 is an accumulator for separating the gas-phase refrigerant and the liquid-phase refrigerant. At the same time, the accumulator 5 temporarily stores redundant refrigerant in the refrigerating cycle. The gas-phase refrigerant discharged out from the accumulator 5 enters the internal heat exchanger 8. The refrigerant is heated by the internal heat exchanger 8 and then sucked into the compressor 1. As described above, the internal heat exchanger 8 is arranged in the refrigerating cycle so that heat can be exchanged between the refrigerant which flows from the radiator 2 to the high pressure control valve 3, and the refrigerant which is returned from the accumulator 5 to the compressor 1. Therefore, the high pressure control valve 3 is arranged in the refrigerant passage formed from the internal heat exchanger 8 to the evaporator 4. These components compose a closed circuit, in which the components are connected to one another by pipes and in the order of compressor 1→radiator 2→internal heat exchanger 8→high pressure control valve 3→evaporator 4→accumulator 5→internal heat exchanger 8→compressor 1. The $CO_2$ refrigerant circulates in the closed circuit.

Next, referring to FIG. 2, the high pressure control valve 3A used for the refrigerating cycle of the first embodiment will be explained below. In a body 33 of the high pressure control valve 3A, a part of the refrigerant passage is formed and leads from the internal heat exchanger 8 to the evaporator 4 through a valve port 33*a*. The body 33 includes: an inlet 33*b* connected to the internal heat exchanger 8 side; an outlet 33*c* connected to the evaporator 4 side; a first opening 33*d* used for arranging a temperature sensing section described later; and a second opening 33*e* used for setting an adjustment spring (coil spring) 36. A valve body 31 is accommodated in the body 33. This valve body 31 opens and closes the valve port 33*a*. Due to the foregoing, an upstream space $C_1$, which is formed in the body 33 and connected to the outlet side of the internal heat exchanger 8, and a downstream space $C_2$, which is connected to the inlet side of the evaporator 4, communicate or do not communicate with each other.

A temperature sensing section is attached to the first opening 33*d* of the body 33. This temperature sensing section includes: a diaphragm 32; a lid body 35; a lower side support member 34; a capillary tube 6 connected to the lid body 35; and a temperature sensing cylinder 7 attached to a foreword end portion of the capillary tube 6. In the temperature sensing section, an airtightly closed space A is formed. That is, when a periphery of the diaphragm 32 is interposed and fixed between the lid body 35, to which the temperature sensing cylinder 7 and the capillary tube 6 are connected, and the lower side support member 34, the temperature sensing section is composed. The diaphragm 32 is a thin-film member made of stainless steel. This diaphragm 32 is deformed and displaced according to a difference in pressure between the outside and the inside. The lower side support member 34 includes: a cylindrical portion 34*a;* and a flange portion 34*b.* When a screw portion formed on the outer circumference of the cylindrical portion 34*a* is screwed to the first opening 33*d* of the body 33, the temperature sensing section is attached to the body 33. In the airtightly closed space A including the temperature sensing cylinder 7 and the capillary tube 6, the $CO_2$, refrigerant which is the same as the refrigerant circulating in the cycle, is charged. In this connection, the temperature sensing cylinder 7 is arranged on the outlet pipe of the radiator 2.

Concerning the valve body 31, one end portion 31*b,* which extends upward from the valve portion 31*a* through the cylindrical portion 34*a* of the lower side support member 34, is fixed to the diaphragm 32. Between the inner face of the cylindrical portion 34*a* and the outer circumferential face of the valve body 31, a gap B, the cross-section of which is annular, is formed. This gap B is communicated with an upstream space $C_1$ connected to the outlet side of the internal heat exchanger 8.

Accordingly, the refrigerant pressure on the outlet side of the internal heat exchanger 8 acts on the diaphragm 32 through this gap B. In this connection, the refrigerant in the airtightly closed space A is mainly affected by the refrigerant temperature on the outlet side of the radiator 2 detected by the temperature sensing cylinder 7.

An adjustment nut 37 is screwed to the other end portion 31*c* of the valve body 31 which extends downward from the valve portion 31*a* through the valve-port 33*a*. Between the periphery of a lower face of the valve port 33*a* and the adjustment nut 37, an adjustment spring (coil spring) 36 is interposed which pushes the valve body 31 so that the valve is closed. When the adjustment nut 37 is rotated, an initial load of the adjustment spring 36 can be arbitrarily adjusted. In this case, the initial load of the adjustment spring 36 is an elastic force generated by the adjustment spring 36 when the valve port 33*a* is closed. The adjustment spring 36, the adjustment nut 37 and others are arranged in a downstream space $C_2$ connected to the inlet side of the evaporator 4. When a cap 38 is attached to the second opening 33*e* of the body 33, the lower portion of the downstream space $C_2$ is closed.

In the high pressure control valve 3A of the first embodiment composed as described above, the valve closing force of the valve body 31 is generated by the inner pressure of the airtightly closed space A and the adjustment spring 36. A valve opening force of the valve body 31 is generated by the refrigerant pressure on the outlet side of the internal heat exchanger 8. When both forces are well balanced with each other, the high pressure control valve 3A can be opened or closed. The inner pressure in the airtightly closed space A is mainly changed by the refrigerant temperature on the outlet side of the radiator 2 in which the temperature sensing cylinder 7 is arranged. When the degree of the valve port 33*a* is changed by the refrigerant temperature on the outlet side of the radiator 2, the refrigerant pressure on the outlet side of the internal heat exchanger 8 is controlled.

Next, an explanations will be given regarding the charging density of $CO_2$ refrigerant, charged into the airtightly closed space A of the high pressure control valve, which is a characteristic of the present invention. In the present embodiment, the internal heat exchanger is provided in the refrigerating cycle. Therefore, in the present embodiment, it is necessary to charge the refrigerant at a lower charging density than the refrigerant charging density charged into the airtightly closed space of the control valve described in the official gazettes of JP-A-9-264622 and JP-A-2000-193347. Specifically, as shown in FIG. 8C, in the case where an internal heat exchanger 8 with a small heat exchanging capacity is used and the control pressure is made to be 15 MPa, at which COP is maximized when the refrigerant temperature of the outlet of the radiator 2 is 60° C. in the case where the superheat (The refrigerant sucked by the compressor is superheated by the internal heat exchanger.) of the sucked refrigerant is 10° C., it is necessary that the refrigerant charging density is maintained at about 600 kg/m$^3$.

Figure 8A:
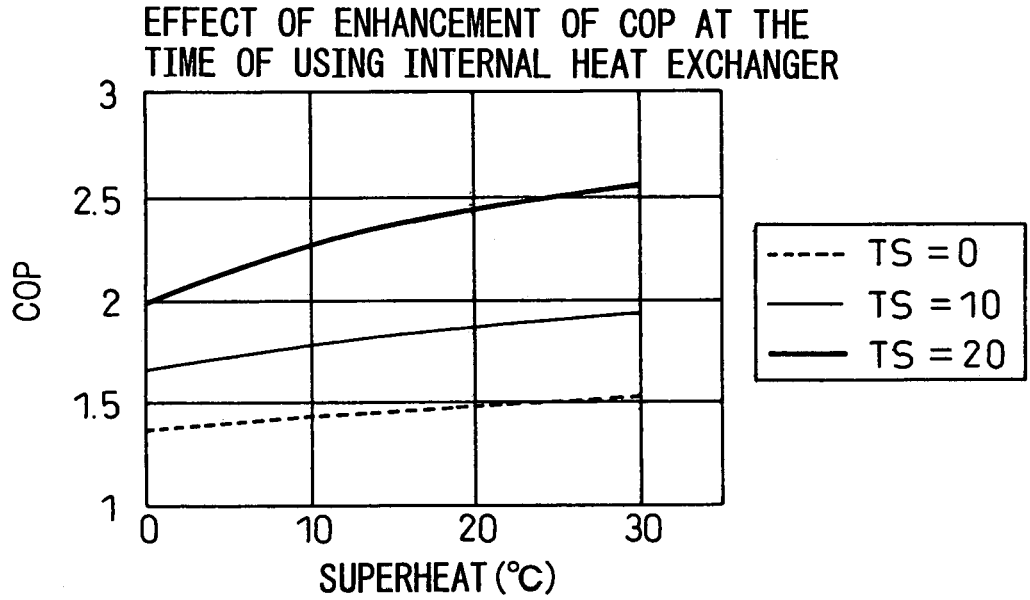
FIG. 8A is a graph for explaining an effect of enhancement of the coefficient of performance (COP) of the refrigerating cycle at the time of using an internal heat exchanger.
Figure 8B:
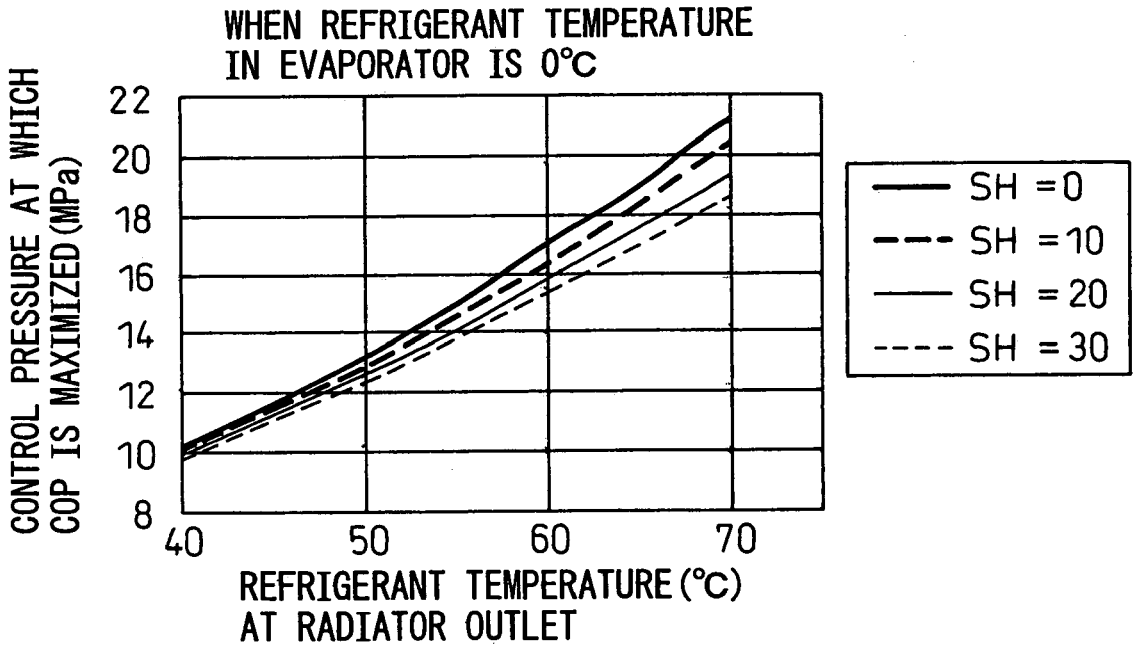
FIG. 8B is a graph showing a high-pressure control pressure at which COP is maximized with respect to a temperature of refrigerant leaving a radiator when the temperature of the refrigerant in the evaporator is 0° C.
Figure 8C:
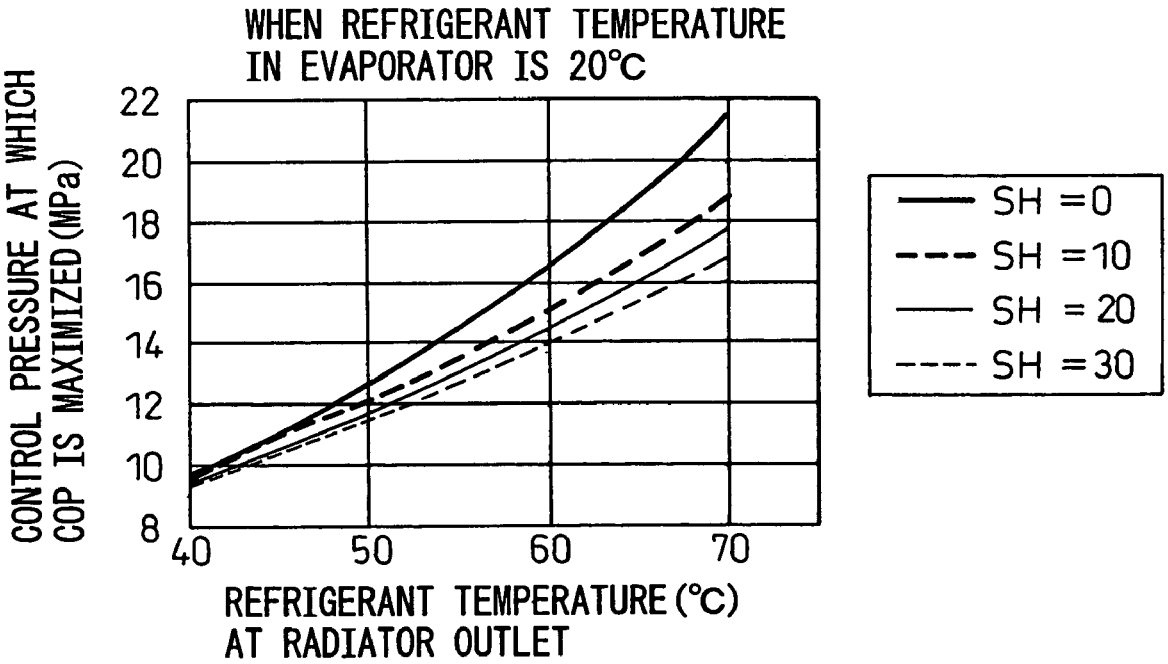
FIG. 8C is a graph showing a high-pressure control pressure at which COP is maximized with respect to a temperature of refrigerant leaving a radiator when the temperature of the refrigerant in the evaporator is 20° C.

Concerning the internal heat exchanger 8, as shown in FIG. 8A, the larger the heat exchanging capacity is, the more the COP is enhanced. On the other hand, when the sucked refrigerant temperature of the compressor 1 is raised, the discharged refrigerant temperature, at the compressor 1, is also raised. Therefore, it is appropriate that the refrigerant is superheated by 15 to 25° C. In this case, in order to make the control pressure 14.2 MPa, at which the COP is maximized when the temperature of the refrigerant leaving the radiator 2 is 60° C., it is necessary that the refrigerant charging density is maintained at about 570 kg/m$^3$.

From the viewpoint of maintaining the pressure proof property of the high pressure control valve 3 as described later, it is preferable that the refrigerant charging density into the airtightly closed space A of the temperature sensing section of the high pressure control valve 3 is low. Therefore, when the inner pressure of the temperature sensing section is decreased by 2 MPa by using a pushing spring (coil spring 36) for pushing the valve in the valve closing direction, even if the refrigerant charging density is made at about 450 kg/m$^3$ when the refrigerant temperature of the outlet of the radiator 2 is 60° C., it is possible to ensure a control pressure, for controlling the high pressure control valve 3, at which the COP is maximized.

In the refrigerating cycle in which $CO_2$ refrigerant is used, the high pressure is controlled by detecting the refrigerant temperature of the outlet of the radiator 2 or the refrigerant temperature of the outlet of the internal heat exchanger 8. Therefore, when the refrigerating cycle is applied to an air-conditioner for vehicle use, the high pressure control valve 3 is necessarily arranged in an engine compartment. As the engine compartment temperature is higher than the outside air temperature and the refrigerant, which has been cooled by the radiator 2, does not flow into the high pressure control valve 3 when the refrigerating cycle is stopped (the compressor 1 is stopped), the high pressure control valve 3 can be heated to the temperature in the engine compartment which is higher than the outside air temperature. Therefore, the high pressure control valve 3 is heated to 100° C. to 120° C. in some cases. As the refrigerant of a predetermined density is charged into the temperature sensing section inside the high pressure control valve 3, if the atmosphere temperature is raised and the charged refrigerant is heated, the inner pressure in the temperature sensing section is suddenly raised.

As the refrigerant temperature at the outlet of the radiator 2 is cooled to a temperature close to the outside air temperature, the maximum temperature in the engine compartment is higher than the maximum temperature of the refrigerant leaving the radiator 2 by 30 to 60° C. For the above reason, at the time of stopping operation, the inner pressure in the temperature sensing section is made higher than the maximum high pressure in the refrigerating cycle using the $CO_2$ refrigerant. Accordingly, a pressure proof property which is much higher than that of other high pressure parts, is required for the temperature sensing section.

Figure 9:
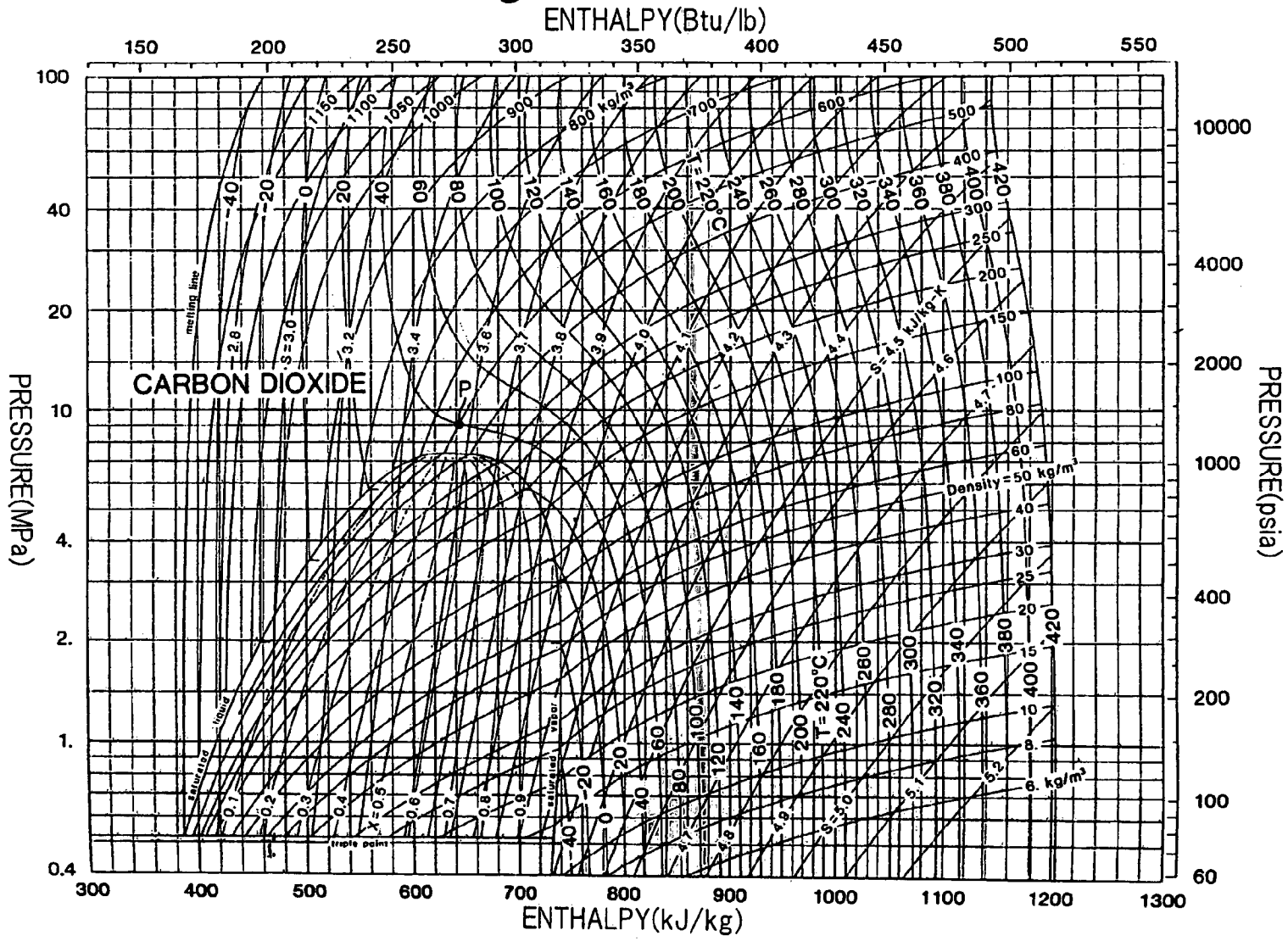
FIG. 9 is the Mollier chart of carbon dioxide ($CO_2$)

As can be seen from the Mollier chart of the $CO_2$ refrigerant shown in FIG. 9, the higher the density is, the more suddenly the pressure is raised with respect to the temperature. Accordingly, in order to reduce an increase in the inner pressure in the temperature sensing section, it is necessary to reduce the charging density of the refrigerant. Especially when the charging density exceeds 600 kg/m$^3$, an inclination of the isothermal line, which crosses the isopycnic line, increases. Accordingly, an increase in the inner pressure, with respect to an increase in the temperature, occurs.

As the maximum allowable pressure of the high pressure parts is set at about 18 MPa, when the upper limit of the pressure in the temperature sensing section is set at the same value, it becomes unnecessary for the mechanical strength of the temperature sensing section to be increased excessively, that is, the mechanical strength of the temperature sensing section can be made to be the same as that of the other high pressure parts. Therefore, it is possible to obtain a high pressure control valve at a low cost.

Therefore, in the present embodiment, the charging density of the $CO_2$ refrigerant into the airtightly closed space of the temperature sensing section must be set as follows.

In the case where the maximum atmosphere temperature is 80° C., the charging density of $CO_2$ refrigerant is not more than about 550 kg/m$^3$.

In the case where the maximum atmosphere temperature is 100° C., the charging density of $CO_2$ refrigerant is not more than about 450 kg/m$^3$.

In the case where the maximum atmosphere temperature is 120° C., the charging density of $CO_2$ refrigerant is not more than about 360 kg/m$^3$.

Even when a position, the temperature of which is low, is chosen as a mounting position in the engine compartment, there is a possibility that the temperature is raised to 100° C., at a maximum. Therefore, it is preferable that the charging density is not more than 450 kg/m$^3$.

In the first embodiment, the adjustment spring (coil spring) 36 applies a load in the direction of opening the valve. However, it is possible that the charging density is reduced by an amount corresponding to the spring load with respect to the target control pressure. Therefore, an elastic force of the coil spring, diaphragm or bellows is more effectively used in this case.

When the charging density of the refrigerant in the temperature sensing section is reduced, the control pressure with respect to the outlet temperature of the radiator 2 is decreased. However, when the internal heat exchanger 8 is used as described before, the control pressure, at which the COP is maximized, is also decreased. Therefore, when the internal heat exchanger 8 is used, it is possible to decrease the refrigerant density of the refrigerant in the temperature sensing section of the high pressure control valve 3 without deteriorating the COP.

In this connection, as shown in the Mollier chart of FIG. 9, when the refrigerant temperature and pressure come close to the critical point, an inclination of the isothermal line is suddenly reduced and a change in the enthalpy is increased with respect to a change in the pressure. When the enthalpy at the outlet of the radiator 2 is increased, an amount of radiation is decreased and the cooling performance is deteriorated. Therefore, it is preferable that the high pressure at the point of time when the refrigerant temperature is 40° C. in the neighborhood of the critical temperature in which the control pressure is reduced is not less than 9 MPa (point P in FIG. 9). Even when a method of giving an initial load by the coil spring 36 is also used, unless the inner pressure of the temperature sensing section at the temperature of 40° C. is 7 MPa or more (2 MPa corresponding to the coil spring load), the cooling performance is remarkably deteriorated. Therefore, it is preferable that the refrigerant charging density when charging the refrigerant into the temperature sensing section is not less than 200 kg/cm$^3$.

At the time of starting the refrigerating cycle using $CO_2$ refrigerant, the high pressure control valve 3 is heated to an atmospheric temperature in the engine compartment. Therefore, the inner pressure in the temperature sensing section is higher than the normal control pressure of controlling high pressure. Therefore, the valve is in a closed state. Accordingly, when a small quantity of refrigerant is circulated from a bleeding hole (not shown) provided in the neighborhood of the valve portion, the refrigerant, which has been cooled by the radiator 2, is made to flow to the high pressure control valve 3 so that it can be used for cooling the temperature sensing section. When the temperature of the temperature sensing section is lowered and the inner pressure of the temperature sensing section is decreased to the control range of controlling high pressure, the high pressure control valve 3 is opened and a flow rate of the refrigerant is increased. Therefore, it is possible to obtain the maximum cooling performance. Accordingly, in order to quicken the cool-down, it is important that the inner pressure in the temperature sensing section is quickly reduced to the normal control pressure range. In order to reduce the inner pressure in the temperature sensing section to the normal control pressure range, it is effective that the control pressure is set at a lower value by using the internal heat exchanger 8 and that the refrigerant charging density into the temperature sensing section of the mechanical type high pressure control valve 3 is decreased.

Figure 10:
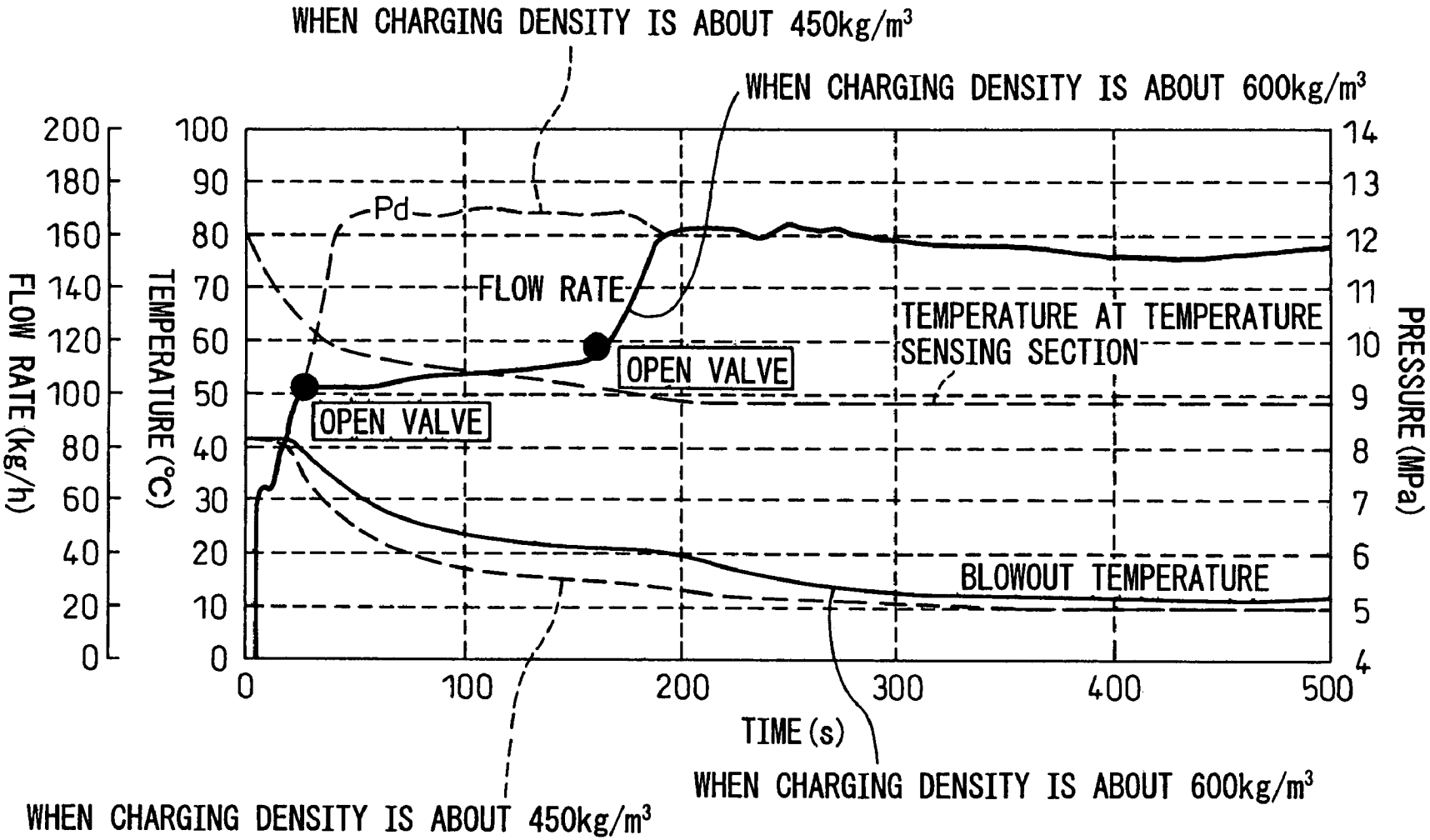
FIG. 10 is a graph for comparing the control characteristics at the time of cool-down.

FIG. 10 is a graph schematically showing an effect obtained at the time of cool-down. Under the condition that the high pressure control valve 3 is heated at about 80° C. in the engine compartment at the time of stopping operation, the refrigerating cycle is started. As the inner pressure of the temperature sensing section exceeds an upper limit (13 MPa in this case) of the refrigerating cycle at this time, the high pressure control valve 3 is closed. Therefore, a small quantity of refrigerant, which has been cooled by the radiator 2, flows from a bleed hole provided close to the valve and cools the temperature sensing section. At this time, the high pressure is controlled by variably changing a capacity of the compressor 1 so that the pressure cannot exceed an upper limit operation pressure.

When the temperature of the temperature sensing section is decreased and the inner pressure becomes lower than the upper limit of operation pressure, the high pressure control valve 3 is opened and the capacity of the compressor 1 is maximized. Therefore, a flow rate of the refrigerant is increased and the maximum cooling performance can be exhibited. In the case where the charging density of charging the refrigerant into the temperature sensing section is high, as compared with a case in which the charging density of charging the refrigerant into the temperature sensing section is low, in order to reduce the inner pressure of the temperature sensing section to be lower than the upper limit of operation pressure, it is necessary that the temperature sensing section is cooled to a lower temperature. Therefore, a period of time needed for cooling the temperature sensing section at the time of starting is prolonged, that is, a period of time, in which a flow rate of the refrigerant is low, is prolonged. Accordingly, it takes a long time to reduce a temperature of a blast of air blown out from an air conditioner for vehicle use.

The charging density of the refrigerant charged into the temperature sensing section is a value under the condition that the valve body is closed or the temperature sensing section is in the maximum capacity state.

Figure 3:
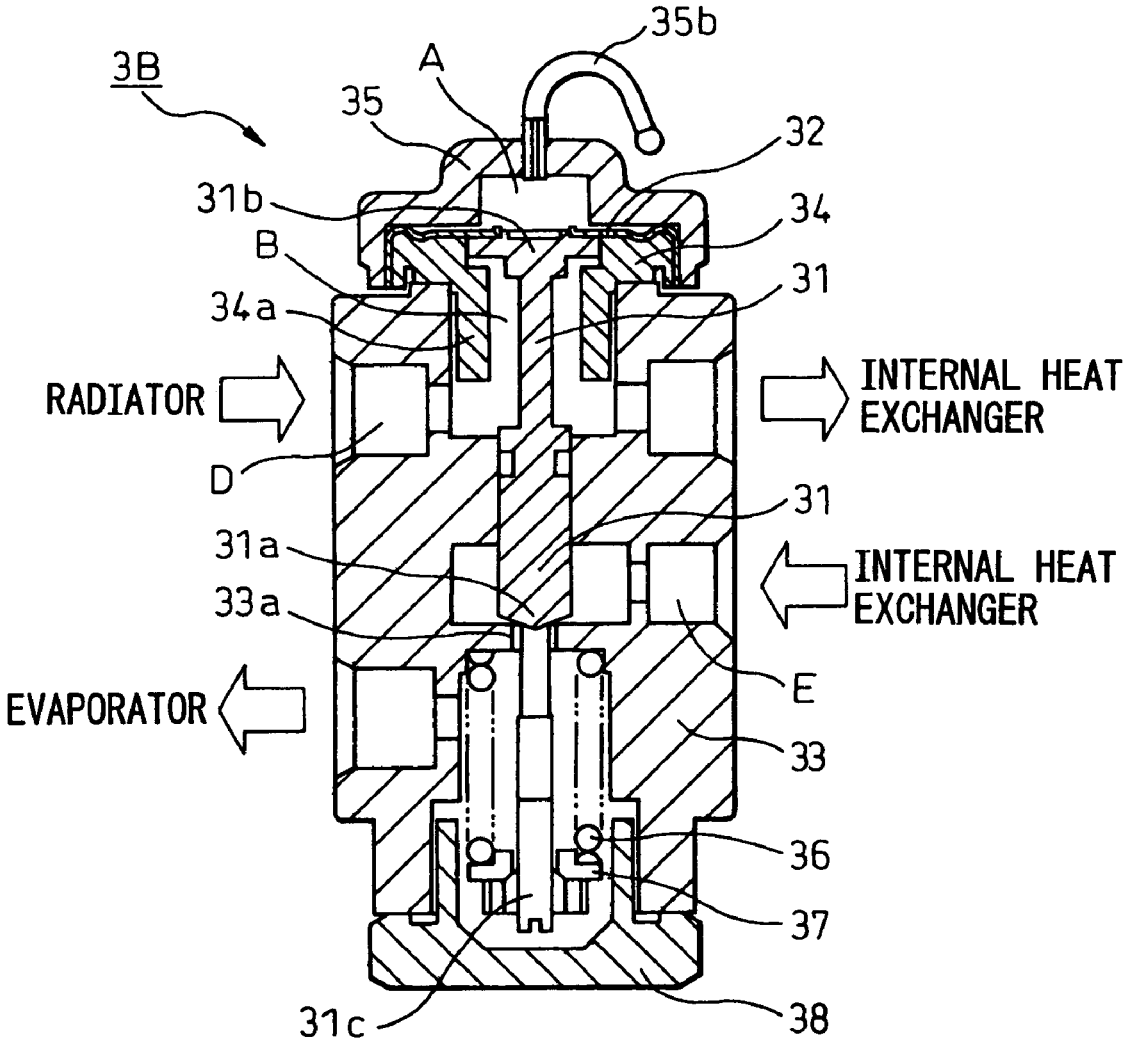
FIG. 3 is a sectional view showing a high pressure control valve of a second embodiment of the present invention.

FIG. 3 is a sectional view showing a high pressure control valve 3B of the second embodiment. In the high pressure control valve 3B of the second embodiment, in the body 33, the first passage D is formed, which is a part of the refrigerant passage formed from the radiator 2 to the internal heat exchanger 8, and the second passage E is formed which is a part of the refrigerant passage formed from the internal heat exchanger 8 to the evaporator 4 through the valve port 33*a*. These first passage D and second passage E are respectively independently formed. In the second embodiment, the capillary tube 6 and the temperature sensing cylinder 7 are removed, and a charging pipe 35*b* used for charging $CO_2$ refrigerant is attached to the lid body 35. The refrigerant is charged from the charging pipe 35*b* into the airtightly closed space A. After the completion of charging the refrigerant, the charging pipe 35*b* is closed. Further, in the second embodiment, the gap B for transmitting the refrigerant temperature on the outlet side of the radiator 2 to the refrigerant in the airtightly closed space A in the temperature sensing section is provided on the first passage D side, and the valve portion 31*a* of the valve body 31 for opening and closing the valve port 33*a* is provided on the second passage E side.

Concerning the valve body 31, one end portion 31*b*, which extends upward from the valve portion 31*a* across the first passage D through the cylindrical portion 34*a* of the lower side support member 34, is fixed to the diaphragm 32, and the gap B, the cross-section of which is annular, is provided between an inner face of the cylindrical portion 34*a* and an outer circumferential face of the valve body 31. This gap B is communicated with the first passage D connected to the radiator 2 outlet side. Accordingly, in the second embodiment, instead of the temperature sensing cylinder 7, the refrigerant on the outlet side of the radiator 2 flows into the gap B, and this refrigerant temperature is transmitted to the refrigerant in the airtightly closed space A of the temperature sensing section. At the same time, the pressure of the refrigerant on the outlet side of the radiator 2 acts on the diaphragm 32.

The valve port 33*a* to communicate the internal heat exchanger 8 with the evaporator 4 is arranged in the second passage E. Accordingly, the adjustment spring 36 and the adjustment nut 37, which are arranged at the other end portion 31*c* of the valve body 31 extending downward through the valve portion 31*a* of the valve body 31 for opening and closing the valve port 33*a* and through the valve port 33*a*, are also arranged in the second passage E.

In the same manner as that of the first embodiment, into the airtightly closed space A of the temperature sensing section, $CO_2$ refrigerant is charged by the charging density 200 to 600 $kg/m^3$. It is preferable that $CO_2$ refrigerant is charged by the charging density 200 to 450 $kg/m^3$.

The other detailed structure of the second embodiment is the same as that of the first embodiment. Therefore, explanations are omitted here.

Figure 4:
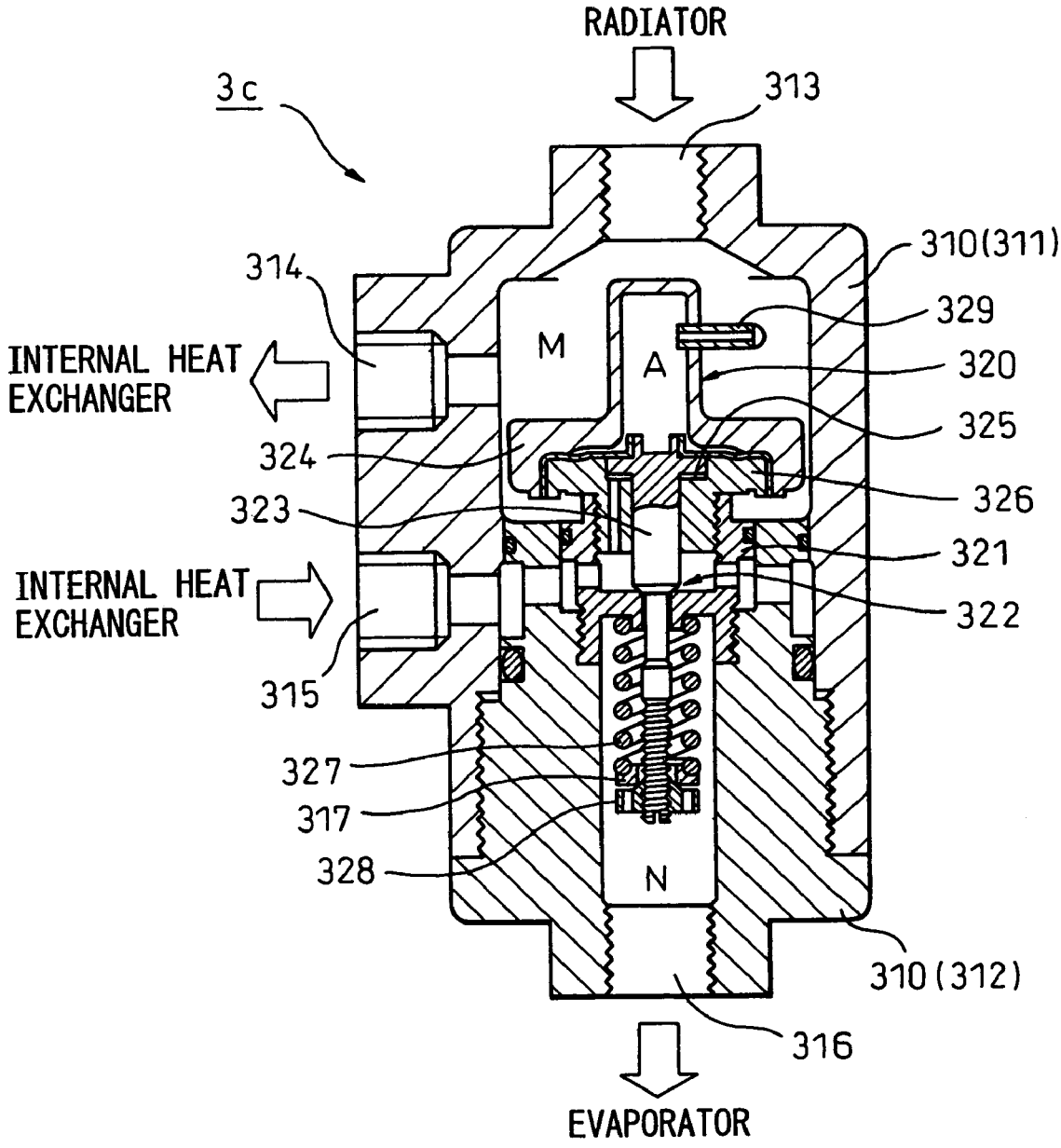
FIG. 4 is a sectional view showing a high pressure control valve of a third embodiment of the present invention.

FIG. 4 is a sectional view showing a high pressure control valve 3C of the third embodiment. The high pressure control valve 3C of the third embodiment is related to a temperature sensing section built-in type high pressure control valve 3C in which the temperature sensing section is arranged inside the refrigerant passage. The high pressure control valve 3C will be explained as follows. Reference numeral 310 is a casing which forms a part (an upstream side space M) of the refrigerant passage formed from the radiator 2 to the internal heat exchanger 8 and also forms a part (a downstream side space N) of the refrigerant passage formed from the internal heat exchanger 8 to the evaporator 4. This casing 310 includes: a first casing 311 in which a first inlet 313 connected to the radiator 2 side, a first outlet 314 connected to the inlet side of the internal heat exchanger 8 and a second inlet 315 connected to the outlet side of the internal heat exchanger 8 are formed; and a second casing 312 in which an opening 317 communicated with the second inlet 315 and a second outlet 316 connected to the evaporator 4 side are formed.

Reference numeral 321 is an attaching portion (bulkhead portion) which forms a portion of the casing of the control valve body 320 and, at the same time, which is used for fixing the control valve body 320 to the second casing 312 by means of screwing. This attaching portion (bulkhead portion) 321 engages with the second casing 312 and partitions a space in the casing 310 into the upstream side space M and the downstream side space N together with a part of the control valve body 320 described later. In the attaching portion 321, a valve port 322 is formed which communicates the internal heat exchanger 8 side with the evaporator 4 side. This valve port 322 is opened and closed by the valve body 323.

In the upstream side space M, an airtightly closed space A, which is a temperature sensing section, is formed. In the middle of this airtightly closed space A, a thin-film diaphragm 325 made of stainless steel, which is deformed and displaced according to a difference in pressure between the inside and the outside of the airtightly closed space A, is interposed. This thin-film diaphragm 325 is formed in such a manner that a circumferential edge of the diaphragm 325 is held between a diaphragm upper side support member 324, which is arranged on end side in the thickness direction of the diaphragm 325, and a diaphragm lower side support member 326 which is arranged on the other end side in the thickness direction of the diaphragm 325.

One end side of the valve body 323 is fixed to the diaphragm 325 and the other end side is screwed to an adjustment nut 328 extending while penetrating the valve port 322. Between the lower face of the valve port 322 and the adjustment nut 328, an adjustment spring (coil spring) 327 for pushing the valve body 323 in the valve closing direction is interposed. When the adjustment nut 328 is turned, an initial load of the adjustment spring 327 can be arbitrarily adjusted.

In the same manner as that of the embodiment described before, into the airtightly closed space A of the high pressure control valve 3C of the third embodiment, $CO_2$ refrigerant is charged through a charging tube 329 attached to the upper side support member 324. The charging density of charging $CO_2$ refrigerant is set at 200 to 600 kg/m$^3$. It is preferable that the charging density of charging $CO_2$ refrigerant is set at 200 to 450 kg/m$^3$.

Accordingly, the high pressure control valve 3C detects a refrigerant temperature on the radiator 2 outlet side by the airtightly closed space located in the upstream side space M and operates by a balance of a sum (valve closing force) of a force generated by the inner pressure with an elastic force of the adjustment spring 327 and a force (valve opening force) generated by the refrigerant pressure on the outlet side of the internal heat exchanger 8.

In this connection, concerning the flow of the refrigerant in the high pressure control valve 3C, two flows are formed. One is a flow which flows from the radiator 2 to the internal heat exchanger 8 through the upstream side space M and the other is a flow which flows from the internal heat exchanger 8 to the evaporator 4 through the downstream side space N (valve port 322).

Figure 5:
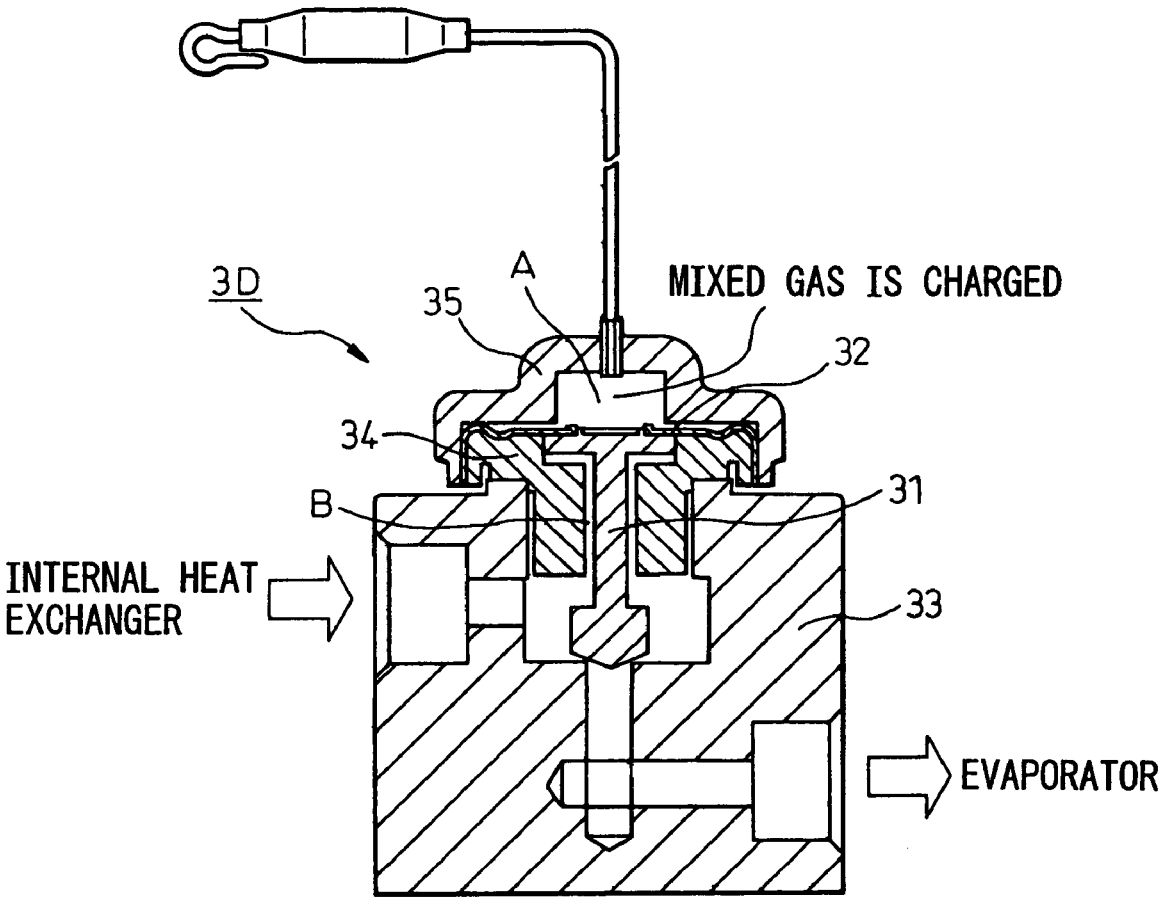
FIG. 5 is a sectional view showing a high pressure control valve of a fourth embodiment of the present invention.

FIG. 5 is a sectional view showing a high pressure control valve 3D of the fourth embodiment. In this fourth embodiment, instead of the adjustment spring 36 provided in the high pressure control valve 3A of the first embodiment shown in FIG. 2, for example, nitrogen gas ($N_2$) or helium gas (He), the coefficient of thermal expansion of which is lower than that of $CO_2$ refrigerant, is charged into the airtightly closed space A together with $CO_2$ refrigerant. That is, the fourth embodiment is composed as follows. The mixed gas, in which the refrigerant and a gas the coefficient of thermal expansion of which is lower than that of the refrigerant, are mixed with each other, is charged into the airtightly closed space A of the temperature sensing section. In the constitution of the first embodiment, the second opening 33*e* of the body 33 is closed, and the extending portion lower than the valve portion 31*a* of the valve body 31, the adjustment spring 36 and the adjustment nut 37 are removed from the constitution of the first embodiment. Other point of the constitution are the same as those of the high pressure control valve 3A of the first embodiment. Therefore, the explanations are omitted here.

In the fourth embodiment, concerning the valve closing force of closing the valve body 31, only an inner pressure acts. The pressure is generated by the mixed gas charged into the airtightly closed space A to which the refrigerant temperature on the outlet side of the radiator 2 is transmitted. Concerning the valve opening force, the refrigerant pressure on the outlet side of the internal heat exchanger 9 acts. As described above, in the fourth embodiment, the gas, the coefficient of thermal expansion of which is lower than that of the refrigerant, fulfills a function of the adjustment spring 36. In the case where the refrigerant is $CO_2$ and the gas to be mixed is $N_2$, the charging density of charging $CO_2$ is 200 to 600 kg/m$^3$. It is preferable that the charging density of charging $CO_2$ is 200 to 450 kg/m$^3$. The charging density of charging $N_2$ is 10 to 40 kg/m$^3$. However, in this case, the charging density of charging $CO_2$ can be reduced by the charging density of charging $N_2$.

Figure 6:
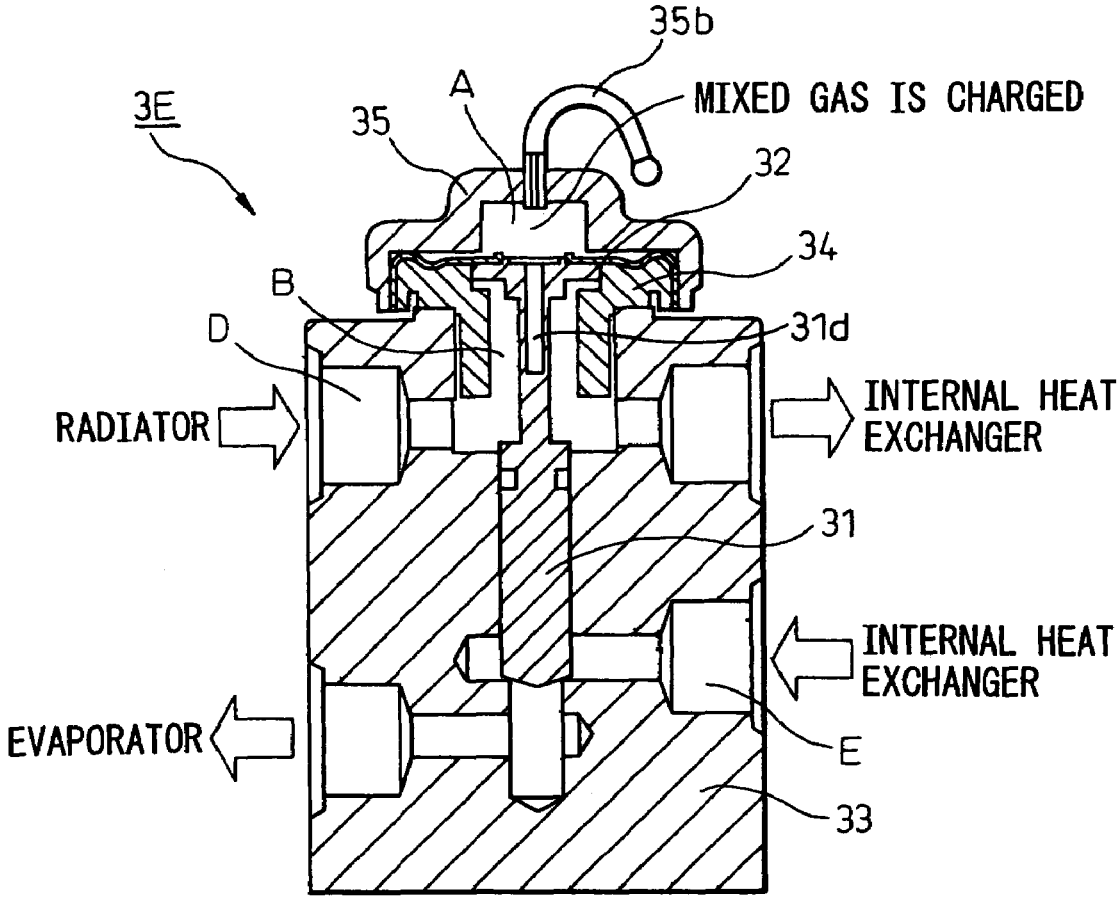
FIG. 6 is a sectional view showing a high pressure control valve of a fifth embodiment of the present invention.

FIG. 6 is a sectional view showing a high pressure control valve 3E of the fifth embodiment. In this fifth embodiment, instead of the adjustment spring 36 provided in the high pressure control valve 3B of the second embodiment shown in FIG. 3, nitrogen gas ($N_2$) or helium gas (He), the coefficient of thermal expansion of which is lower than that of $CO_2$ refrigerant, is charged into the airtightly closed space A together with $CO_2$ refrigerant. That is, the fifth embodiment is composed as follows. The mixed gas, in which the $CO_2$ refrigerant and the gas, the coefficient of thermal expansion of which is lower than that of the $CO_2$ refrigerant, are mixed with each other, is charged into the airtightly closed space A which is a temperature sensing section. In the constitution of the fifth embodiment, the second opening 33*e* of the body 33 is closed. Further, the extending portion lower than the valve portion 31*a* of the valve body 31, the adjustment spring 36 and the adjustment nut 37 are removed from the constitution of the second embodiment. Other points of the constitution are the same as those of the high pressure control valve 3B of the second embodiment. Therefore, explanations are omitted here. The mixed gas charged into the airtightly closed space A is the same as that of the fourth embodiment. Therefore, explanations are omitted here.

Figure 7:
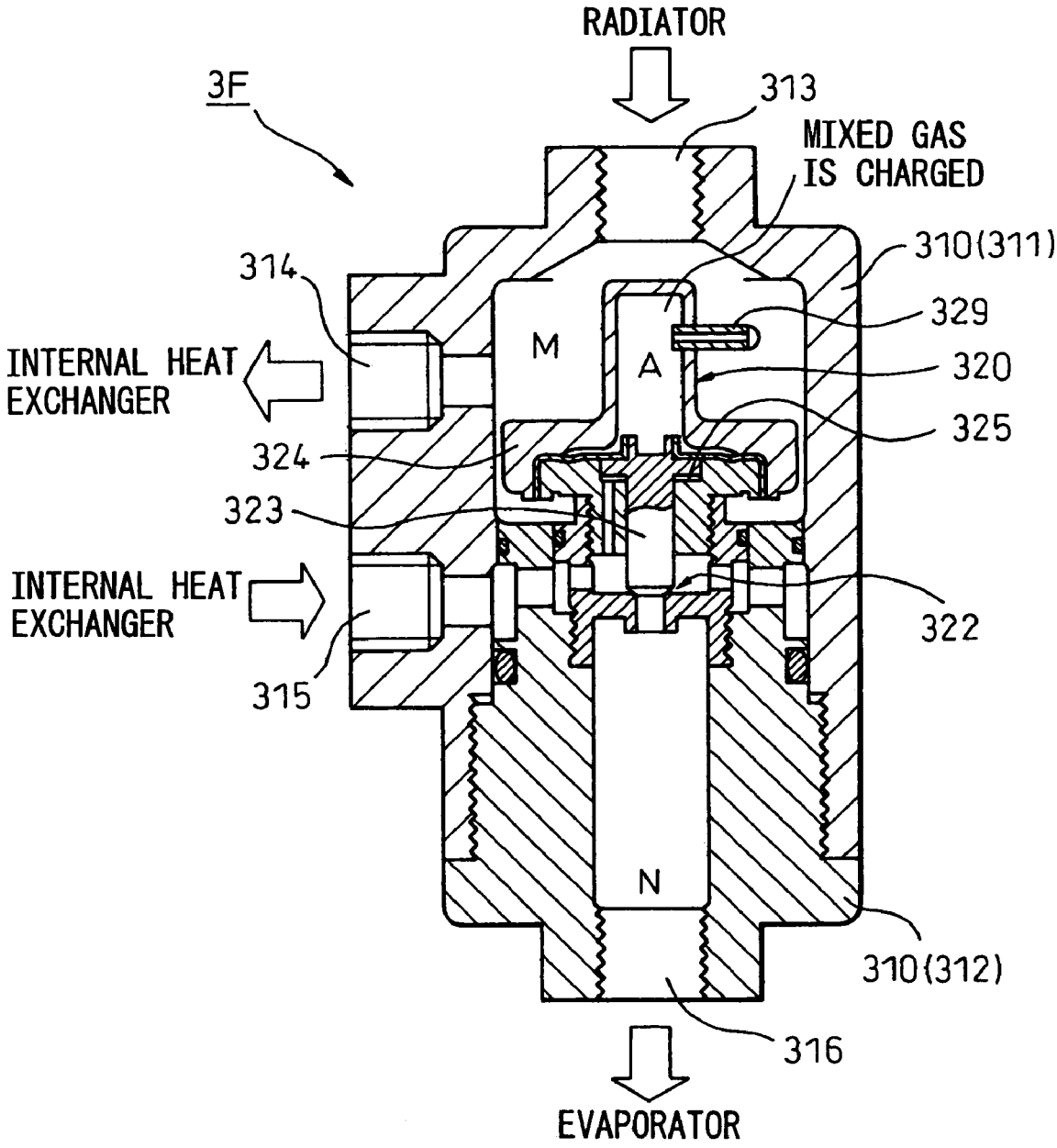
FIG. 7 is a sectional view showing a high pressure control valve of a sixth embodiment of the present invention.

FIG. 7 is a sectional view showing a high pressure control valve 3F of the sixth embodiment. In this sixth embodiment, instead of the adjustment spring 327 provided in the built-in type high pressure control valve 3C of the third embodiment shown in FIG. 4, nitrogen gas ($N_2$) or helium gas (He), the coefficient of thermal expansion of which is lower than that of $CO_2$ refrigerant, is charged into the airtightly closed space together with $CO_2$ refrigerant. That is, the sixth embodiment is composed as follows. The mixed gas, in which the $CO_2$ refrigerant and the gas, the coefficient of thermal expansion of which is lower than that of the $CO_2$ refrigerant, are mixed with each other, is charged into the airtightly closed space A which is a temperature sensing section. From the constitution of the third embodiment, the extending portion lower than the valve port 322 of the valve body 323, the adjustment spring 327 and the adjustment nut 328 are removed. Other points of the constitution are the same as those of the high pressure control valve 3C of the third embodiment. Therefore, the explanations are omitted here. The mixed gas charged into the airtightly closed space A is the same as that of the fourth embodiment. Therefore, the explanations are omitted here.

In this connection, in each embodiment described above, to generate a pushing force for closing the valve body 31, 323, not only an adjustment spring (coil spring) but also a diaphragm or bellows can be used.

As explained above, the present embodiment can be applied to any types of the high pressure control valves 3A to 3F including the temperature sensing cylinder type high pressure control valves 3A, 3D of the first embodiment shown in FIG. 2 and the fourth embodiment shown in FIG. 5 and including the box type high pressure control valves 3B, 3E in which the temperature sensing section is provided in the box-shaped body portion as shown in the second embodiment shown in FIG. 3 and the fifth embodiment shown in FIG. 6 and including the built-in type high pressure control valves 3C, 3F in which the temperature sensing section is built in the refrigerant passage as shown in the third embodiment shown in FIG. 4 and the sixth embodiment shown in FIG. 7. The important point is that $CO_2$ refrigerant is charged into the airtightly closed space A, which is a temperature sensing section, by the charging density 200 to 600 kg/m$^3$. It is preferable that $CO_2$ refrigerant is charged into the airtightly closed space A by the charging density 200 to 450 kg/m$^3$. Due to the foregoing, in the refrigerating cycle of $CO_2$ refrigerant into which the internal heat exchanger is incorporated, COP of the refrigerating cycle can be enhanced and the cool-down speed can be increased in the case where the refrigerating cycle is applied to an air conditioner for vehicle use.

By reducing the charging density of charging $CO_2$ refrigerant into the airtightly closed space of the temperature sensing section, it becomes unnecessary to excessively increase the mechanical strength of only the temperature sensing section, that is, the mechanical strength of the temperature sensing section can be made to be the same as that of the other high-pressure parts. Accordingly, the manufacturing cost of the high pressure control valve can be reduced.

While the invention has been described by reference to specific embodiments chosen for purposes of illustration, it should be apparent that numerous modifications could be made thereto by those skilled in the art without departing from the basic concept and scope of the invention.

The invention claimed is:

1. A high pressure control valve, arranged in a refrigerant passage extending from an internal heat exchanger to an evaporator in a refrigerating cycle, in which refrigerant, a pressure of which is a supercritical pressure, is used, having the internal heat exchanger in which heat exchange is conducted between the refrigerant at an outlet of a radiator and the refrigerant sucked into a compressor, the high pressure control valve controlling refrigerant pressure on an internal heat exchanger outlet side by adjusting a degree of opening of a valve port according to a temperature of the refrigerant at the outlet of the radiator, the high pressure control valve comprising:

a temperature sensing section, an inner pressure of which is changed according to a refrigerant temperature between the outlet of the radiator and an inlet of the internal heat exchanger;

a valve body for adjusting the degree of opening of the valve port being mechanically linked with a change in the inner pressure of the temperature sensing section; and a body for accommodating the valve body, wherein a charging density of charging the refrigerant into the temperature sensing section is equal to or greater than 200 $kg/m^3$ and less than 450 $kg/m^3$ under a condition that the valve body is closed.

2. A high pressure control valve according to claim 1, wherein the high pressure control valve is opened when the high pressure is raised higher than the inner pressure of the temperature sensing section by a predetermined value.

3. A high pressure control valve according to claim 2, wherein a load corresponding to the predetermined value is provided by either an elastic member or a noncondensable gas charged into the temperature sensing section together with the refrigerant or by a combination of them.

4. A high pressure control valve according to claim 3, wherein a force of the elastic member is an elastic force of a coil spring, an elastic force generated by a diaphragm itself or an elastic force generated by a bellows or an elastic force generated by a combination of them.

5. A high pressure control valve according to claim 1, wherein when the temperature of the refrigerant at the outlet of the radiator is not less than 50° C. and the refrigerant sucked by the compressor is heated by the internal heat exchanger so that the superheat can be 10° C. or more.

6. A high pressure control valve according to claim 1, wherein the temperature sensing section includes a temperature sensing cylinder for detecting the temperature of the refrigerant at the outlet of the radiator and a capillary tube connected between the temperature sensing section and the body of the high pressure control valve.

7. A high pressure control valve according to claim 1, wherein a first passage through which the refrigerant from the outlet of the radiator flows to the temperature sensing section and a second passage through which the refrigerant from the outlet of the internal heat exchanger flows to an outlet of the body via the valve body are formed in the body of the high pressure control valve.

8. A high pressure control valve in combination with a refrigeration system, the high pressure control valve being arranged in a refrigerant passage extending from an internal heat exchanger of the refrigeration system to an evaporator of the refrigerating system, in which refrigerant, a pressure of which is a supercritical pressure, is used, having the internal heat exchanger in which heat exchange is conducted between the refrigerant at an outlet of a radiator of the refrigeration system and the refrigerant sucked into a compressor of the refrigeration system, the high pressure control valve controlling refrigerant pressure on an internal heat exchanger outlet side by adjusting a degree of opening of a valve port according to a temperature of the refrigerant at the outlet of the radiator, the high pressure control valve comprising:

a temperature sensing section, an inner pressure of which is changed according to a refrigerant temperature between the outlet of the radiator and an inlet of the internal heat exchanger;

a valve body for adjusting the degree of opening of the valve port being mechanically linked with a change in the inner pressure of the temperature sensing section; and a body for accommodating the valve body, wherein a charging density of charging the refrigerant into the temperature sensing section is equal to or greater than 200 $kg/m^3$ and less than 600 $kg/m^3$ under a condition that the valve body is closed.

9. A refrigeration cycle comprising:

a compressor;

a radiator having an inlet in communication with an outlet of said compressor;

an evaporator having an inlet in control with an outlet of said radiator and an outlet in communication with an inlet said compressor;

an internal heat exchanger having a first inlet in communication with said outlet of said radiator, a first outlet in communication with an inlet of said evaporator, a second inlet in communication with said outlet of said evaporator and a second outlet in communication with said inlet of said compressor; and a high pressure control valve having an inlet in communication with said first outlet of said internal and an outlet in communication with said inlet of said evaporator, said high pressure control valve comprising:

a temperature sensing section, an inner pressure of which is changed according to a refrigeration temperature at said outlet of said radiator;

a valve body for adjusting a degree of opening of a valve port being mechanically linked with a change in the inner pressure of said temperature sensing section; and a body for accommodating said valve body.

10. The refrigeration cycle according to claim 9, wherein a charging density of charging the refrigerant into the temperature sensing section is 200 to 600 $kg/m^3$ under a condition that the valve body is closed.

11. The refrigeration cycle according to claim 9, wherein a charging density of charging the refrigerant into the temperature sensing section is equal to or greater than 200 $kg/m^3$ and less than 450 $kg/m^3$ under a condition that the valve body is closed.

* * * * *